US005607704A

United States Patent [19]

Schlierenkämper et al.

[11] Patent Number: 5,607,704

[45] Date of Patent: Mar. 4, 1997

[54] PRESS RAM FOR A PELLETING MACHINE

[75] Inventors: Rüdiger Schlierenkämper; Jürgen Schikowski, both of Schwarzenbek, Germany

[73] Assignee: Wilhelm Fette GmbH, Schwarzenbek, Germany

[21] Appl. No.: 451,558

[22] Filed: May 26, 1995

[30] Foreign Application Priority Data

Jun. 3, 1994 [DE] Germany ..... 9409108 U

[51] Int. Cl.[6] ..... B30B 11/00

[52] U.S. Cl. ..... 425/183; 425/193; 425/352; 425/469

[58] Field of Search ..... 425/182, 183, 425/193, 344, 352, 469

[56] References Cited

U.S. PATENT DOCUMENTS

| | | | |
|---|---|---|---|
| 2,630,041 | 3/1953 | Perry et al. | 425/78 |
| 2,777,162 | 1/1957 | Banzhof, Jr. | 425/193 |
| 2,954,583 | 10/1960 | Gregory et al. | 425/469 |
| 3,466,707 | 9/1969 | Click et al. | 425/193 |
| 4,475,880 | 10/1984 | Crossley et al. | 425/469 |
| 5,314,323 | 5/1994 | Bolles | 425/193 |

FOREIGN PATENT DOCUMENTS

| | | | |
|---|---|---|---|
| 2948242 | 6/1981 | Germany | 425/193 |
| 58-136427 | 8/1983 | Japan | 425/469 |
| 15970 | 8/1902 | Sweden | 425/193 |
| 588141 | 1/1978 | U.S.S.R. | 425/469 |
| 810525 | 3/1981 | U.S.S.R. | 425/193 |
| 1237468 | 6/1986 | U.S.S.R. | 425/469 |

*Primary Examiner*—C. Scott Bushey
*Attorney, Agent, or Firm*—Vidas, Arrett & Steinkraus

[57] ABSTRACT

A press ram for use in a pelleting machine for making tablets including a rod-shaped ram holder, having at one end a head for engagement with cams and at its other end an axial bore, a ram insert, having at one end a pressing portion shaped in conformity with the profile of a tablet and at another end a cylindrical shaft, which is substantially matingly received in the bore of the ram holder, a radial shoulder of the ram insert thereby engaging the facing end of the ram holder, and a mechanism for releasably holding the ram insert within the ram holder. An improvement in the press ram including the wall of the bore of the ram holder including a groove, the ram insert including an axial bore for receiving an actuating pin at an end remote from the pressing portion, which actuating pin cooperates with at least one clamping element within a radial bore so as to urge the clamping element or a further clamping element actuatable by the first mentioned clamping element into the groove of the ram holder when the actuating pin is moved in a direction towards the clamping element.

9 Claims, 2 Drawing Sheets

PRESS RAM FOR A PELLETING MACHINE

BACKGROUND OF THE INVENTION

The present invention relates to a press ram for use in a pelleting machine for making tablets, comprising a rod-shaped ram holder having at one end a head for engagement with cams and at its other end an axial bore, a ram insert having at one end a pressing portion shaped in conformity with the profile of a tablet and at another end a cylindrical shaft which is substantially matingly received in the bore of the ram holder, with a radial shoulder of the ram insert engaging the facing end of the ram holder, and means for releasably holding the ram insert within the ram holder.

Such press rams are used in rotary pelleting machines for making tablets of a great variety of materials and for a great variety of applications. A press die plate usually driven about a vertical axis includes a plurality of dies having associated therewith a pair of press rams rotating synchronously with the die plate. Actuation of the press rams is effected via cams and pressure rollers.

It has become known to make such press rams of two parts. They comprise a rod-shaped ram holder having at one end a head for engagement with the cams and pressure rollers and at the other end an axial bore. Furthermore, they comprise a ram insert having a shaft which fits into the bore and has a portion projecting from the ram holder and serving as a pressing portion of a shape in conformity with the shape of the die. It has become known to fix the ram insert by means of a bolt to the ram holder and to secure it by means of an obliquely extending fixing bolt. In such a construction the ram inserts in the machine cannot be changed. Furthermore, there is a certain risk of the bores for the fixing bolts being filled with the material to be compressed. As a result cleaning thereof is difficult.

Furthermore, it has become known to fix the shaft of the ram insert at the ram holder by means of a radial fitting pin. Also this type of fixing does not allow for simple exchange of the ram insert.

It is an object of the present invention to provide a press ram for use in a pelleting machine wherein the ram insert may be readily exchanged by the users.

SUMMARY OF THE INVENTION

In the press ram of the present invention the wall of the bore of the ram holder includes a groove. The ram insert has at its end remote from the pressing portion an axial bore for receiving an actuating pin which cooperates with at least one clamping element so as to urge the clamping element into the groove of the bore of the ram holder and to fix the ram insert at the ram holder. The clamping element is actuated via an actuating pin which is received in an axial bore and which is actuated preferably by a bolt positioned in a radial threaded bore. Such bolt may have a conical end which cooperates with a conical end of the actuating pin so as to displace it axially for actuating the clamping element.

In one embodiment of the invention, the actuating pin may be positioned in an axial bore of the ram holder. In this case also the threaded bolt is positioned within the ram holder for displacing the actuating pin. According to a further development of the invention, the ram insert includes in the area of the radial bore an annular groove receiving a resilient ring which is deformed when said clamping element is driven radially outwards. The clamping element may be for example a ball or a clamping pin. The clamping element is formed and cooperates with the groove within the ram holder so that the radial shoulder of the ram insert fully engages one end of the ram holder when a resilient ring is deformed by the clamping element into the groove of the ram holder.

According to a further development of the invention the actuating pin is positioned within the ram insert. Both for this embodiment and the above mentioned embodiment it may be suitable for the ram insert to include in the area of the radial bore an annular groove which receives an O-ring for urging the clamping element radially inwards. The O-ring prevents that the clamping element becomes lost when the ram insert has been disassembled. Furthermore, it moves the clamping element radially inwards when the actuating pin is being withdrawn so that the clamping element may be readily withdrawn from the bore of the ram holder.

A third possibility of exchanging the ram insert is to provide the ram insert with external threads cooperating with internal threads of the bore of the ram holder.

The press ram for rotary pelleting machines of the present invention is advantageous in that the ram holder may be kept available as a spare part while the ram insert may be specifically shaped in accordance with the demands of the user. In an embodiment where the actuating pin alone is positioned within the ram insert the ram holder does not have any bores or cuts so that there is no risk of damaging any sealing rings within the rotary pelleting machine. In the described embodiments of the invention at least the upper die allows for exchange of the ram insert within the machine itself, and this can be done readily and in a simple manner without the use of special tools. These manipulations can be performed also by the user.

BRIEF DESCRIPTION OF THE DRAWINGS

The present invention will be explained in more detail with reference to the drawings which show two embodiments of the invention.

DETAILED DESCRIPTION OF THE PREFERRED EMBODIMENTS

Figure 1:
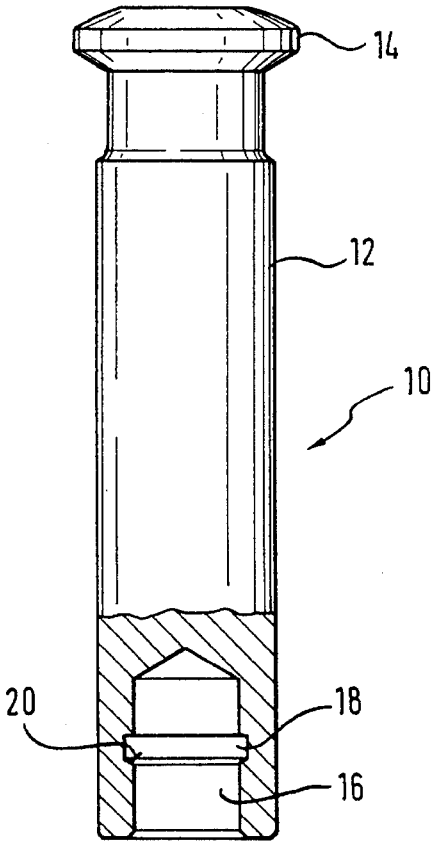
FIG. 1 is a side elevation, partially in cross-section, of a ram holder of the invention.

The ram holder 10 of FIG. 1 comprises a cylindrical rod 12 having at its upper end a head 14 which is spherical at its outside. The head 14 cooperates with cams and pressure rollers in a rotary pelleting machine for making tablets. In the case as shown the ram is a so-called upper ram cooperating with the upper ends of dies at a die plate. The following comments apply similarly to lower rams.

At its other end the rod 12 includes a blind bore 16 in which an annular groove 18 is formed. The annular groove 18 has a chamfer 20 facing towards the outside.

Figure 2:
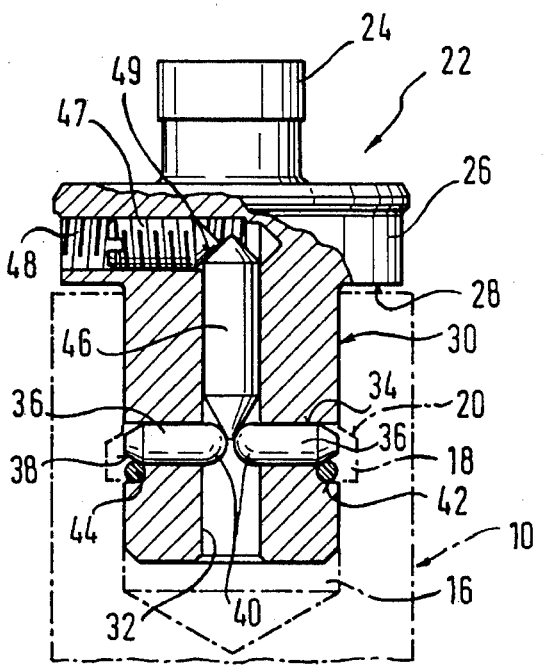
FIG. 2 shows, in an enlarged scale, a ram insert for connection with the ram holder of FIG. 1 in a first operative position.
Figure 3:
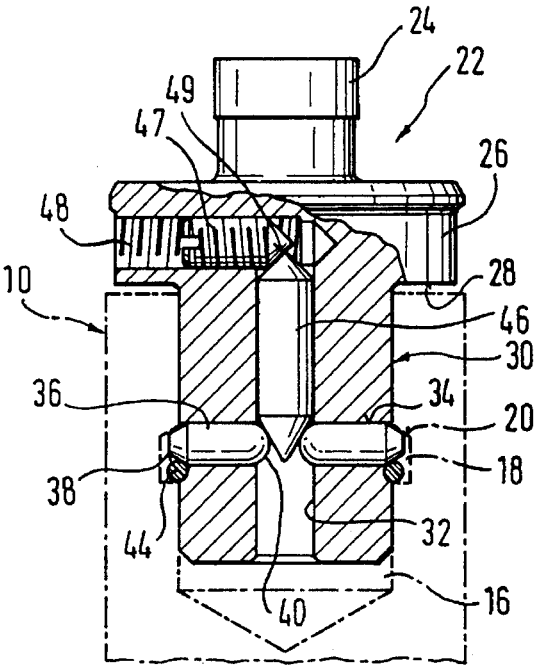
FIG. 3 shows the ram insert of FIG. 2 in a second operative position.

In FIGS. 2 and 3 the ram holder 10 is indicated by dash-dotted lines. It has been rotated for 180° as compared to the position shown in FIG. 1. The ram includes a ram insert 22 having a pressing portion 24 the shape of which is in conformity with that of the die in the die plate of the rotary pelleting machine. A cylindrical portion 26 of increased diameter defines a shoulder 28 which cooperates with the end of the ram holder 10. The ram insert 22 comprises a cylindrical shaft 30 which is fitted into the bore 16. The ram insert 22 has an axial bore 32 which is provided at the end remote from the pressing portion 24. The axial bore 32 is in communication with three radial bores 34 which are circumferentially spaced for 120° from each other. The radical bores 34 receive clamping pins 36 which have conical ends as shown at 38. At their internal ends the clamping pins 36 are spherical and shown at 40. An annular groove adjacent the bores 34 and designated by 42 receives an O-ring 44. It engages against the conical end 38 of the clamping pins so as to urge them inwards and to prevent the clamping pins 36 from dropping out. Furthermore, the bore 32 slidingly receives an actuating pin 46 having conically shaped ends. A radial threaded bore 48 receives a bolt 47 the forward end of which is conical as shown at 49.

When the bolt 47 is rotated so as to be moved radially inwards, the actuating pin 46 is moved downwards, with the lower conical ends of the clamping pins 36 being moved radially outwards into engagement with the annular groove 18 of the ram holder 10. As a result, the ram insert 22 is securely fixed at the ram holder 10. The conical shapes of the outer ends of the clamping pins 36 and the chamfer 22 cooperate so as to exert axial pressure onto these parts so that the shoulder 28 of the ram insert is tightly urged against the face of the ram holder 10.

The ram insert 22 is released by rotating the bolt 47 in the opposite direction. The O-ring 44 causes the clamping pins 36 to be moved inwards far enough so that the ram insert 22 may be readily withdrawn from the ram holder 10 and be replaced by another ram insert.

Figure 4:
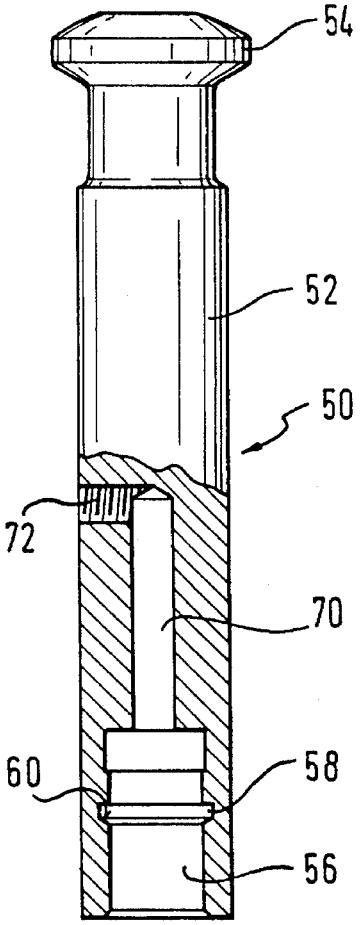
FIG. 4 is a side elevation, partially in cross-section, of another ram holder according to the invention.

FIG. 4 shows a ram holder 50 having a rod 52 provided with a head 54 similar to the ram holder 10 in FIG. 1. Also the bore 56 at the end opposite the head 54 is similarly provided with an annular groove 58 which has a chamfer at 60. The bore 56 communicates with an adjacent axial bore 70 which terminates in a radial bore 72. The bore 70 receives an actuating pin 74 having conical ends 76, 78.

Figure 5:
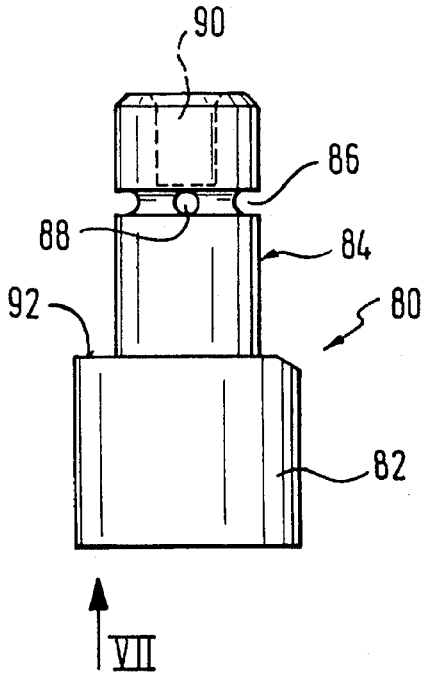
FIG. 5 shows a ram insert, in an enlarged scale, for connection with the ram holder of FIG. 4.
Figure 6:
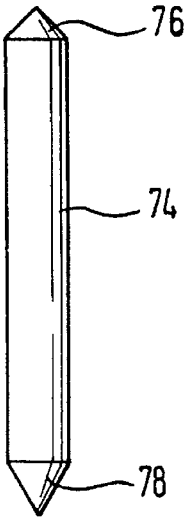
FIG. 6 shows an actuating pin for the ram holder of FIG. 4.
Figure 7:
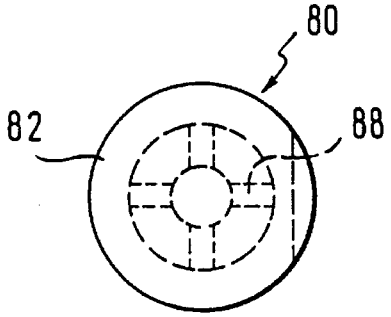
FIG. 7 is an end view of the ram insert of FIG. 5.

FIGS. 5 and 7 show a ram insert 80 having a pressing portion 82 and a shaft 84. The shaft 84 includes an annular groove 86 wherein four radial grooves circumferentially spaced for 90° terminate, with one of such grooves being shown at 88. Above the annular groove 86 there is provided an axial groove as indicated by dotted lines at 90.

When the shaft 84 is inserted into the bore 56, the annular groove 86 is at the level of the annular groove 58, when the radial shoulder 92 of the ram insert 84 is in abutment with the associated end of the ram holder 50. The bores 88 receive pins (not shown) in a similar manner as in FIGS. 2 and 3. They can be moved radially outwards by means of the actuating pin 74 in order to move a resilient ring (also not shown) into engagement with the groove 58. As an alternative the clamping pins can be provided in the same manner as in FIGS. 2 and 3 so as to cooperate with an O-ring similar to O-ring 44 in order to define quick closing means in the manner as already described. For actuating the actuating pin 75 there is provided a bolt (not shown) which is threaded into the radial threaded bore 72.

The ram insert can have a predetermined orientation with respect to the ram holder when the latter is axially guided, for example by key means. This is necessary if the die is not circular. Such orientation may be ensured by markings or by axial positive guiding of the ram insert within the ram holder.

It is to be noted that the ram insert can be made of another material than the ram holder.

We claim:

1. A press ram for use in a pelleting machine for making tablets including a rod-shaped ram holder having at one end a head for engagement with cams and at its other end a facing end having an axial bore, a ram insert having at one end a pressing portion shaped in conformity with the profile of a tablet and at another end a cylindrical shaft which is substantially matingly received in the bore of the ram holder, with a radial shoulder of the ram insert engaging the facing end of the ram holder, and means for releasably holding the ram insert within the ram holder, the improvement of which comprises the wall of the bore of the ram holder including a groove, the ram insert including an axial bore for receiving an actuating pin at an end remote from said pressing portion, which actuating pin cooperates with at least one clamping element within a radial bore so as to urge the at least one clamping element into the groove of the ram holder when the actuating pin is moved in a direction towards the at least one clamping element.

2. A press ram as defined in claim 1, wherein said actuating pin has ends of conical shape and one of said ends of conical shape cooperates with a clamping bolt positioned within a radially extending threaded bore.

3. A press ram as defined in claim 1, wherein said actuating pin is positioned within a bore of a ram holder.

4. A press ram as defined in claim 3, wherein the ram insert includes in the area of the radial bore an annular groove receiving a resilient ring which is deformed when said at least one clamping element is driven radially outwards.

5. A press ram as defined in claim 1, wherein said at least one clamping element comprises a clamping pin.

6. A press ram as defined in claim 1, wherein said actuating pin is slidably mounted within an axial bore of said ram insert.

7. A press ram as defined in claim 6, wherein said ram insert includes in the area of said radial bore an annular groove receiving an O-ring which biasses said at least one clamping element radially inwards.

8. A press ram as defined in claim 6, wherein said at least one clamping element comprises a clamping pin, the clamping pin having a conical shaped end.

9. A press ram as defined in claim 1, wherein said ram holder and said ram insert are made of different materials.

* * * * *